US010624406B2

(12) United States Patent
Todaro

(10) Patent No.: US 10,624,406 B2
(45) Date of Patent: Apr. 21, 2020

(54) PROTECTIVE SPORTS HELMET

(71) Applicant: Richard Todaro, Miami Beach, FL (US)

(72) Inventor: Richard Todaro, Miami Beach, FL (US)

( * ) Notice: Subject to any disclaimer, the term of this patent is extended or adjusted under 35 U.S.C. 154(b) by 216 days.

(21) Appl. No.: 15/703,270

(22) Filed: Sep. 13, 2017

(65) Prior Publication Data

US 2018/0070666 A1 Mar. 15, 2018

Related U.S. Application Data

(60) Provisional application No. 62/394,843, filed on Sep. 15, 2016.

(51) Int. Cl.

| | |
|---|---|
| ***A42B 3/06*** | (2006.01) |
| ***A63B 71/10*** | (2006.01) |
| ***A42B 3/12*** | (2006.01) |
| ***A42B 3/28*** | (2006.01) |
| ***A42B 3/30*** | (2006.01) |
| ***A42B 3/04*** | (2006.01) |
| ***A42B 3/08*** | (2006.01) |
| ***A42B 3/20*** | (2006.01) |

(52) U.S. Cl.

CPC ..... *A42B 3/063* (2013.01); *A42B 3/046* (2013.01); *A42B 3/0453* (2013.01); *A42B 3/062* (2013.01); *A42B 3/08* (2013.01); *A42B 3/125* (2013.01); *A42B 3/20* (2013.01); *A42B 3/283* (2013.01); *A42B 3/30* (2013.01); *A63B 71/10* (2013.01)

(58) Field of Classification Search

CPC ..... A42B 3/063; A42B 3/0453; A42B 3/046; A42B 3/062; A42B 3/08; A42B 3/125; A42B 3/20; A42B 3/283; A42B 3/30; A42B 3/00; A42B 3/06; A42B 3/061; A42B 3/067; A42B 3/069; A42B 3/10; A42B 3/12; A42B 3/127; A42B 3/128; A42B 3/064; A63B 71/10

USPC ..... 2/410, 411, 412, 414, 421

See application file for complete search history.

(56) References Cited

U.S. PATENT DOCUMENTS

| | | | | |
|---|---|---|---|---|
| 5,477,563 | A * | 12/1995 | Gentes | A42B 3/062 2/411 |
| 6,385,781 | B1 * | 5/2002 | Rose | A42B 3/00 2/421 |
| 6,854,133 | B2 * | 2/2005 | Lee | A42B 3/063 2/412 |
| 8,898,818 | B1 | 12/2014 | Whitcomb | |
| 9,271,537 | B2 | 3/2016 | Nelson | |
| 2014/0000011 | A1 * | 1/2014 | Johnson | A42B 3/121 2/413 |

(Continued)

*Primary Examiner* — Anna K Kinsaul
*Assistant Examiner* — F Griffin Hall

(57) ABSTRACT

The present helmet invention combines lightweight, impact absorption materials, force distribution structures, and means for affixing a facemask and straps to the helmet for reducing the risk of head injury. The internal construction of the helmet uses the combination of three or more elliptically shaped rings, each referred to as a "halo ring." The halo rings are rigidly affixed to u-shaped torsion bars, and together form a cage. The cage covers areas of the head and skull vulnerable to injury, operating to disperse and thereby dissipate external impacts at any point where forces on the helmet's external surface are transferred to the ovoid-like cage.

16 Claims, 9 Drawing Sheets

(56) References Cited

U.S. PATENT DOCUMENTS

| | | | | |
|---|---|---|---|---|
| 2015/0299903 | A1* | 10/2015 | Tanaka | D01F 6/04 442/1 |
| 2016/0199720 | A1 | 7/2016 | Withnall et al. | |
| 2016/0235133 | A1 | 8/2016 | Chase, Jr. et al. | |
| 2016/0242485 | A1 | 8/2016 | Carton | |
| 2016/0242486 | A1 | 8/2016 | Harris et al. | |
| 2017/0049178 | A1* | 2/2017 | Durocher | A42B 3/127 |
| 2017/0189786 | A1* | 7/2017 | Riggs | A42B 3/122 |

* cited by examiner

PROTECTIVE SPORTS HELMET

FIELD OF THE INVENTION

The invention relates to a protective helmet worn by a player during a contact sport, such as football, lacrosse, hockey, baseball, or in a non contact sport such as motocross, cycling, skiing, or snowboarding.

BACKGROUND OF THE INVENTION

Concussions and other head injuries are a major concern for athletes and others participating in activities where the head may be subjected to force. Concussions are a form of traumatic brain injury (TBI) and can range in severity from mild to life threatening. It is now known that concussions are more than temporary impairments of neurological function, which tend to resolve spontaneously, although, may have long lasting affects.

Repetitive concussions are extremely serious and can result in permanent structural changes to the brain, such as thinning of the corpus collosum, and are linked to chronic traumatic encephalopathy (CTE), a degenerative brain disease characterized by: memory loss, mood swings, cognitive impairment, depression, confusion, aggression and the decline of motor skills. Some studies have suggested that CTE may triple the risk of an early death.

The risk of concussions and other head trauma is especially prevalent in American football due to the number of impacts a player's head may receive. Despite every football player wearing a helmet, football has the highest incidence of concussions of the major sports. This fact illustrates that there is a need for a helmet that will further reduce the likelihood of a player receiving a concussion.

In order to understand how helmets may be improved, the different types of forces that can cause head trauma need to be understood. The two major types of forces are acceleration-deceleration (or linear impact) and rotational (or angular impact).

Briefly a linear impact occurs when a person's head is struck by a "straight-line" force causing the head to move in the direction opposite of the force. During such an impact the forces may cause the brain to move relative to the skull possibly even causing the brain to strike the inside of the skull. This movement and potential striking of the brain may cause stretching and tearing of neurons or brain cells.

An angular impact causes the head to experience rotational acceleration and is different from a linear impact. In this case, a force causes the head to rotate on its axis (corresponding to the neck) from side to side in a twisting motion. When a player's head is forced to rotate quickly over a large degree of rotation, nerve cells and blood vessels in the brain can be stretched and twisted. The twisting and tearing of an axon may result in the death of the neuron. Consequently the damage caused by rotational impacts may be particularly severe.

Helmets are designed to prevent head injuries, including concussions, by absorbing the impact forces to the head. The helmet should absorb and redirect that energy. Existing helmets do not effectively absorb linear impacts. They are also poor at absorbing rotational impacts. As a result of their potential severity, rotational impacts may be the cause of more sport concussions than linear impacts.

Current helmets are constructed with a hard outer shell using a chin strap to fix the helmet around the person's head, to protect against linear impacts. Current helmets typically use of an outer polycarbonate surface (hard) and an inner layer of heavy, snug fitting and shock absorbing padding (foam, air cells, etc.). Such helmet designs may be effective at absorbing the force of hard hits to the head and preventing both skull fractures and direct impact concussions by distributing the force across the entire surface area of the helmet. However, the shock absorbing padding is designed to fit closely to the player's head; if the helmet receives a rotational impact that rotates the helmet, the head is subject to the same rotational impact and also will rotate on its axis (neck) as a result of the shock absorbing padding.

Current football helmets in use today are not effective at providing protection against external forces that cause rotational impacts, which may lead to concussions. The inner padding fits so close to a player's head that rotational impacts to the helmet also cause rotation of the person's head. Adding to the danger is the general shape of helmets, especially helmets with facemasks, which may actually increase the amount of rotational force placed upon the player's head. This is a consequence of the force hitting the helmet a distance away from the head. The helmet may essentially act as a force multiplier (e.g. analogous to a gear or wheel) to increase the torque twisting the player's head.

In addition, the exterior of many sports helmets such as football helmets are designed in such a way that is likely to cause abrasions both to the player and to other participants. By way of example, and not limitation, helmets typically have a snap located on the exterior of the helmet for receiving a male-female snap attached to a chin strap and are typically accompanied by a bulky sizing mechanism. Other helmet designs have external hardware, brackets or screws used to affix helmet components such as a facemask to the helmet. These devices may create points of contact that may result in abrasions or lacerations to either the wearer or other participants.

What is needed is a light weight helmet that diverts and absorbs the energy caused by collisions to the head and reduces the potential for injury to the wearer and other participants.

SUMMARY OF THE INVENTION

The present helmet invention combines lightweight, impact absorption materials, force distribution structures, and means for affixing a face mask and straps to the helmet for reducing the risk of head injury.

The internal construction of the helmet creates an impact cage, that combinations u-shaped bars and elliptically shaped rings ("halo ring(s)") and is then covered with one or more shock absorbent materials. The cage covers areas of the head and skull vulnerable to injury, operating to disperse and thereby dissipate external impacts at any point where forces on the helmet's external surface are transferred to the ovoid-like cage. The major and minor axes of the largest halo ring, referred to as "halo-1," are of a dimension designed to fit over the head of the player. Halo-1 protects the mandibular and occipital regions of the skull, protecting the skull from fracture and protecting the brain from forces that might cause injuries, such as contusion and concussion. Another halo ring, smaller in diameter than halo-1, is referred to as "halo-2" and is located above and essentially parallel to halo-1. The major and minor axes of halo-2 are of sufficient dimension so as to protect the side and back of the head, including the frontal, temporal and parietal regions of the skull and related areas of the brain. Another halo ring of a smaller dimension than halo-2, is referred to as "halo-3" is and located above and essentially parallel to halo-2. The major and minor axes of halo-3 are of sufficient dimension so as to protect the crown of the head, including the frontal, the right and left temporal and parietal regions of the skull and related areas of the brain.

In one non-limiting embodiment, one or more of the halo-1 or halo-2 rings may extended beyond the specified regions to form the foundation of one or more facemask protectors. By way of example, and not limitation, halo-1 may be further elongated beyond the mandibular region of the chin to form the base of an integrated chin protector. In addition, or independently, halo-2 may be further elongated beyond the right and left regions of the temporal region including the zygomatic bones, to form a single or additional integrated facemask. The final dimension of an extended halo ring may vary in height, depth, or thickness based on a variety of factors such as weight, the type of sport for which the helmet is used, or other non-safety related factors such as appearance or player comfort.

Two or more inverted "U" shaped bars, each referred to as a "u-shaped bar" or simply "u-bar", intersects with each halo ring to form a protective cage. By way of example, and not limitation, a first u-shaped bar may be oriented about the frontal and the right and left temporal regions of the skull, while a second u-shaped bar is oriented over the crown of the skull over the left and right parietal regions and behind the ears, while a third u-bar is oriented over the occipital region of the skull.

In another non-limiting embodiment, one or more partial halo rings may be inserted essentially parallel to and below halo ring-2 to form a protective facemask area, such as placement of a partial halo ring forward of the maxilla region of the skull, and placed between halo-1 and halo-2. In an additional non-limiting embodiment, two or more halo rings, may be connected by way of an intersecting post to provide facemask stability or player protection.

As stated, the internal construction of the helmet uses the combination of three or more elliptical halo ring(s). The rings are rigidly affixed to a plurality of inverted u-bars, and together form a section of an ovoid cage, which is inserted into a helmet cavity. In an alternate embodiment, additional u-bars may be inserted parallel to and between halo-1 and halo-2 to form one of a facemask. The halos and u-bars are attached together by any means that will form a solid cage structure such as welding or by using a material to cohesively bond the halos and u-bars together, including the use of epoxy or other chemical means of bonding two materials together. Thereafter, the cage is coated with a material such as thermoplastic powder coating, typically used to cover helmet facemasks. In furtherance of reducing the forces of impact, a lightweight, thin perforated shell conformably fits over the cage or alternatively, the shell conformably fits into the underside of the cage. The shell may be constructed by way of example and not limitation, from a thin high strength plastic or a lightweight titanium material. The shell has perforations of varying diameter or configuration to permit permeation of a cushioning material described below, through the shell to help adhere the cage to the shell. Other perforations will serve to provide anchors for the chin straps also described below, and larger perforations may serve to provide airflow between the inner and outer surfaces of the helmet for player comfort.

In one embodiment, clips are used to secure the coated cage to the shell. At one end, the clip has a tab for insertion into a shell perforation. The other end of the clip snaps over or otherwise attaches to a halo ring or u-bar securing the shell to the cage.

In one embodiment, two or more chin straps are anchored to the coated cage. The chin strap fabric has an elastic quality that provides both a means for further securing the helmet to the users head as well as a providing expansion or contraction give that allows the helmet to move in order to reduce the amount of torque on the head or chin. The chin straps may be anchored by any secured means, including wrapping the chin strap fabric over one or more members of the coated cage and then either sewing or riveting the end of the chin strap fabric to itself. The coated cage is then placed in a mold, however excluding from the mold, that portion of the cage that includes the chin straps and facemask. The coated cage within the mold is covered with a layer of cushioning material, which may be achieved for example through the process of injection molding, or by pouring the cushioning material into the mold. During the molding process, the chin straps and/or facemask are protected so as to not cover them with the cushioning material. If a second layer of cushioning is applied as further described below, the chin straps and facemask are also protected so as to not cover them. The cushioning material used in the molding process may include a synthetic viscoelastic urethane polymer ("SVUP"), such as SORBOTHANE® (a registered trademark of SORBORTHANE, Inc.) or alternatively, other material having similar shock attenuating and vibration dampening properties. In an alternate embodiment, the molded assembly is covered with second cushioning material, such as an ethylene vinyl acetate ("EVA") copolymer, such as CROSLITE® (a registered trademark of Croc, Inc.) or alternatively, other closed cell resin materials. The application of the second cushioning material may be accomplished by such processes and techniques well known to those skilled in the art of manufacturing, and may include, but are not limited to dipping, spraying, submersion or injection molding. The SVUP and EVA copolymer each serve to attenuate shock and dampen vibration.

In yet another embodiment, a helmet includes three or more elliptically shaped rings, each having major and minor axes of different dimension, proportional to the size and shape of a user's head, which rings rigidly affix, concentrically over three or more inverted parabolic shaped bars, each of the bars align in parallel, from the back to the front of the helmet, and wherein the vertical position of the rings, on the bars accord with the dimension of the elliptical rings that are arranged successively and horizontally over the bars, from the largest dimension, at the base of the helmet to the smallest uppermost position on the aligned bars, the cage structure forming an ovoid-like cage.

The cage forms the support for a perforated shell in the general shape of the helmet. The shell has an inner and outer surface with perforations of varying size, shape, quantity, and placement, to allow for the flow of air or sound, and permits the affixation thereon of the cage, and a combination of impact absorbent materials, which sandwich the shell, generally between its outer and inner surfaces. The impact absorbent materials are generally comprised of two separate materials; a layer nearest the shell of the SVUP and/or an outer layer of the EVA copolymer.

The process of layered cushioning having an outer layer of EVA copolymer and inner layer of SVUP, or having alternating layers of such cushioning material may also be used in related sports equipment, by way of example and not limitation, shoulder pads, knee pads, chest pads, back pads, leg pads (thigh, shin), and inner helmet cushioning separate and apart from the helmet described herein. By way of example, and not limitation, the helmet may be worn together with a conformable cap that contains one or more of cushioning materials described herein.

In an alternate embodiment, one or more of the layers are separated by a shell, or a layer of polyethylene powder coating.

In still another embodiment, the cage provides anchor points for the chin straps to attach to the helmet eliminating the need for external hardware (e.g., screws, brackets, face guard) used in traditional helmets, thus reducing the potential for injury to other players.

As indicated, the cage may be covered with an outer cushioning layer, such as CROSLITE, or other durable, closed cell resin outer coating. A resin, such as CROSLITE, provides several advantages over the prior art, which is typically constructed with a hard outer shell plastic known as polycarbonate alloy. By way of example, and not limitation, exterior use of a closed cell resin increases impact absorption unlike today's helmets made of a plastic alloy. This characteristic extends helmet durability and reduces wear that can occur during frequent or prolonged use, including non-safety related scuffing or scratching that may occur during use or storage. Resins such as CROSLITE are available in a wide range of colors. During manufacturing of the helmet disclosed herein, the outer coating may be molded to add identifiers such as a team logo or name, or player name or number. Some closed cell resins have anti-microbial properties reducing odor, and obviate the need for harsh chemicals, especially when a helmet is used by multiple players. Also, resin will easily adhere to a wide range of other cushioning systems, materials or spacers that may also be used in conjunction with the final helmet to enhance safety and comfort.

Vents may be installed in one embodiment for comfort, cooling, hearing, or a chin strap installation and access. The vents may remain open or clear throughout the layering process. Alternatively, these vents are made clear, during the finishing process.

In yet another embodiment, embedded in one or more of the cushioning layers are flexible crush resistant tubes. The tubes serve as weight reducers, additional air cushioning, and are used also as a means for detecting the location of an impact. The closed end of the tube is located within the closed cell resin cushioning layer. The distal end of the tube terminates at the base of the finished helmet. The tube temporarily deforms upon impact forcing air to escape, and thereafter returns substantially to its original shape. Alternatively, the distal end of each tube terminates at the finished helmet base into which is inserted a relief valve. The relief value remains closed until activated by a pre-determined impact force causing the valve to open.

In an alternate embodiment, the tube and valve system may serve as a low cost visual early warning system by providing the general location of an impact that may be result in serious physical injury, or death, and which may be recorded and tracked by automated or manual means, for a variety of purposes, including player health and safety, helmet wear, injury tracking. For example, the relief valve may remain closed until activated by an impact force that causes the value to open. The opening of the valve may then trigger a visual indicator, such as a brightly colored or color-coded button-type indicator, light emitting diode (LED) or sensor activated light, or release of a powder, liquid, gel or combination non-toxic, non-staining, substance. The visual indicator may in some cases relate to one or a group of relief tubes to indicate the location of impact. By way of example, and not limitation an impact to the left temporal region may trigger a visual indicator such as the release of one or more bright red release valve buttons, whereas an impact to the right temporal region may trigger the release of one or more bright green release valve buttons.

In an alternate embodiment one or more of the trigger valves contains a wireless technology, such as BLUETOOTH® (Bluetooth is a registered trademark of Bluetooth SIG, Inc.). Upon impact, the valve opens triggering a visual indicator, which may include the activation of a sensor that measures one or more of the following: acceleration, gyroscopic position of the helmet in relation to the skull, or a GPS sensor. Sensor data is thereafter transmitted via wireless transmission to a receiver, such as a smart-tablet or smartphone, to indicate the nature of the impact and location.

In another non-limiting embodiment, all or a portion of the facemask area of the helmet generally located below the topmost ring halo, i.e., ring halo-2, may be fitted with an optional clear, shatterproof shield, to provide added face protection. The shield may have other characteristics such as hard coating for scratch resistance, ultraviolet coating for eye protection against ultraviolet rays, lens polarization for glare or one or more photochromic lens(es) that respond to changing light conditions. Alternatively, the shield may also permit the use of visual technology enhancements, known generally as "Google Glass" or technologies that may allow players to access and view playbooks, record plays in real-time, gather and share information useful to the game play, or allow for audiovisual communication among players or between players and coaches.

BRIEF DESCRIPTION OF THE DRAWINGS

Understanding of the present invention will be facilitated by consideration of the following detailed description of the preferred embodiments of the present invention taken in conjunction with the accompanying drawings, in which like numerals refer to like parts, and wherein.

DETAILED DESCRIPTION OF THE INVENTION

Figure 1:
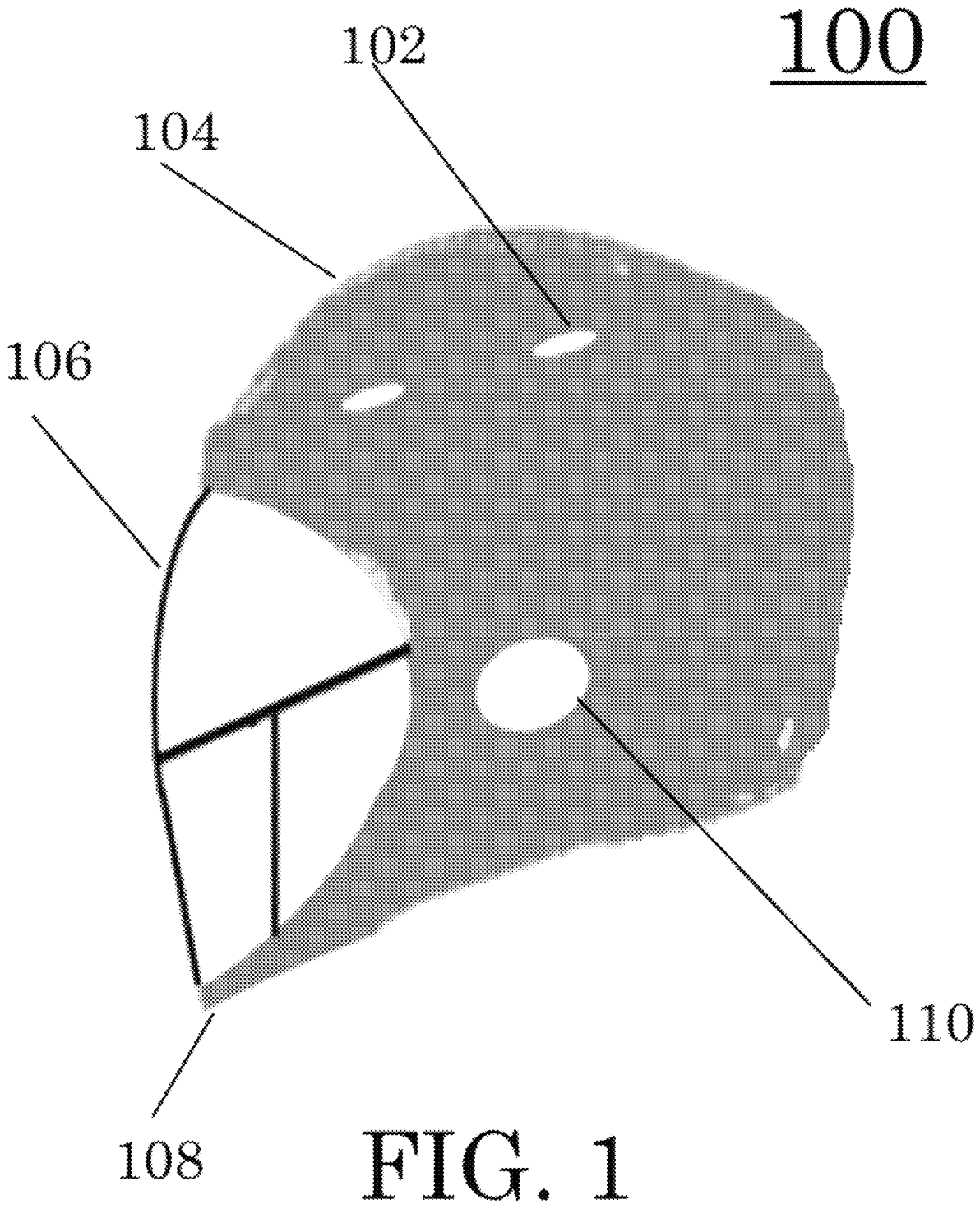
FIG. 1 shows a side view of a helmet in accordance with an embodiment of the invention.

It is to be understood that the figures and descriptions of the present invention have been simplified to illustrate elements that are relevant for a clear understanding, while eliminating, for the purpose of clarity, many other elements, or geometric shapes, found in sports helmets. Those of ordinary skill in the art may recognize that other elements and/or steps may be desirable in implementing the present invention. However, because such elements and steps are well known in the art, and because they do not facilitate a better understanding of the present invention, a discussion of such elements and steps is not provided herein. Throughout the following detailed description the same reference numerals refer to the same elements in all figures.

The following detailed description includes the best mode of carrying out the invention and is made for the purpose of illustrating the general principles of the invention and should not be taken in a limiting sense. The scope of the invention is determined by reference to the claims. Each part or function is assigned, even if structurally identical to another part, a unique reference number wherever that part is shown in the drawing figures.

Figure 2:
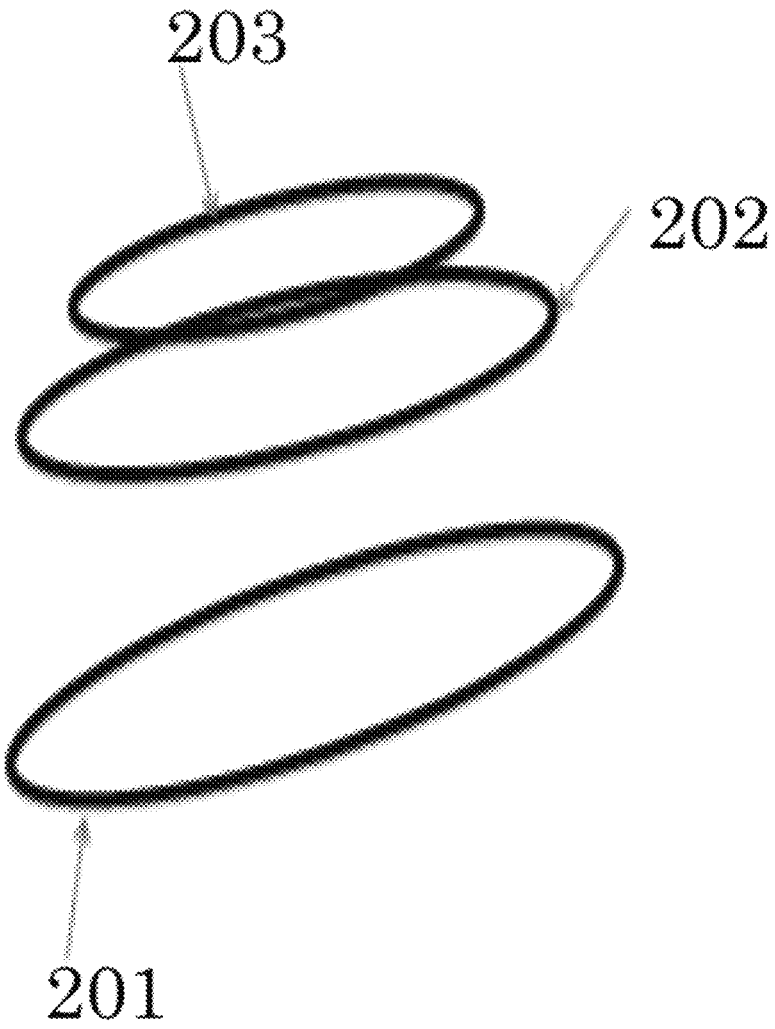
FIG. 2 shows the halo rings in accordance with an embodiment of the invention.
Figure 3:
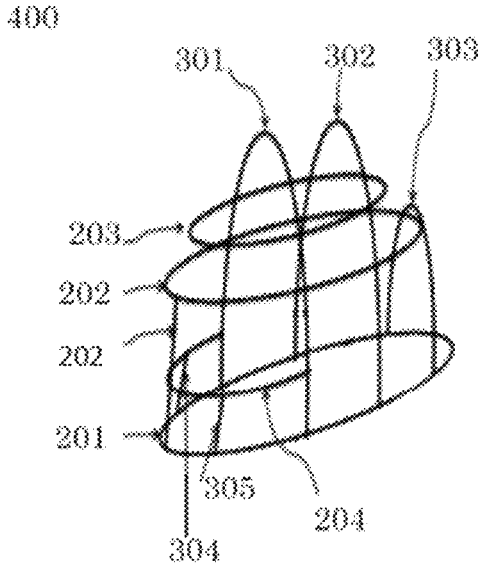
FIG. 3 shows the halo rings and u-shaped bars forming a cage assembly in accordance with an embodiment of the invention.

Referring to FIG. 1, in a non-limiting embodiment of the invention, helmet 100 includes a helmet outer cover 104, having air vents 102 and sound vent 110, a face mask structure 106, and chin terminus 108. FIG. 2 and FIG. 3 show a portion of the internal structure of the invention, wherein three or more elliptically shaped rings 201, 202 and 203, each having a major and minor axis, commensurate with the size of a respective section of a user's skull, are assembled concentrically and then rigidly affixed to three or more inverted parabolic shaped u-shaped bars 301, 302 and 303. The bars are in a substantially parallel alignment, wherein the vertical position of the rings on the bars, are concentrically arranged, according with the dimension of the rings, from a largest dimension to a smallest dimension, to form a partial ovoid cage 400 structure. Structure 304 and 305 serve to further stabilize the rings and the bars, and permit the addition of other accessories such as a facemask.

Figure 4:
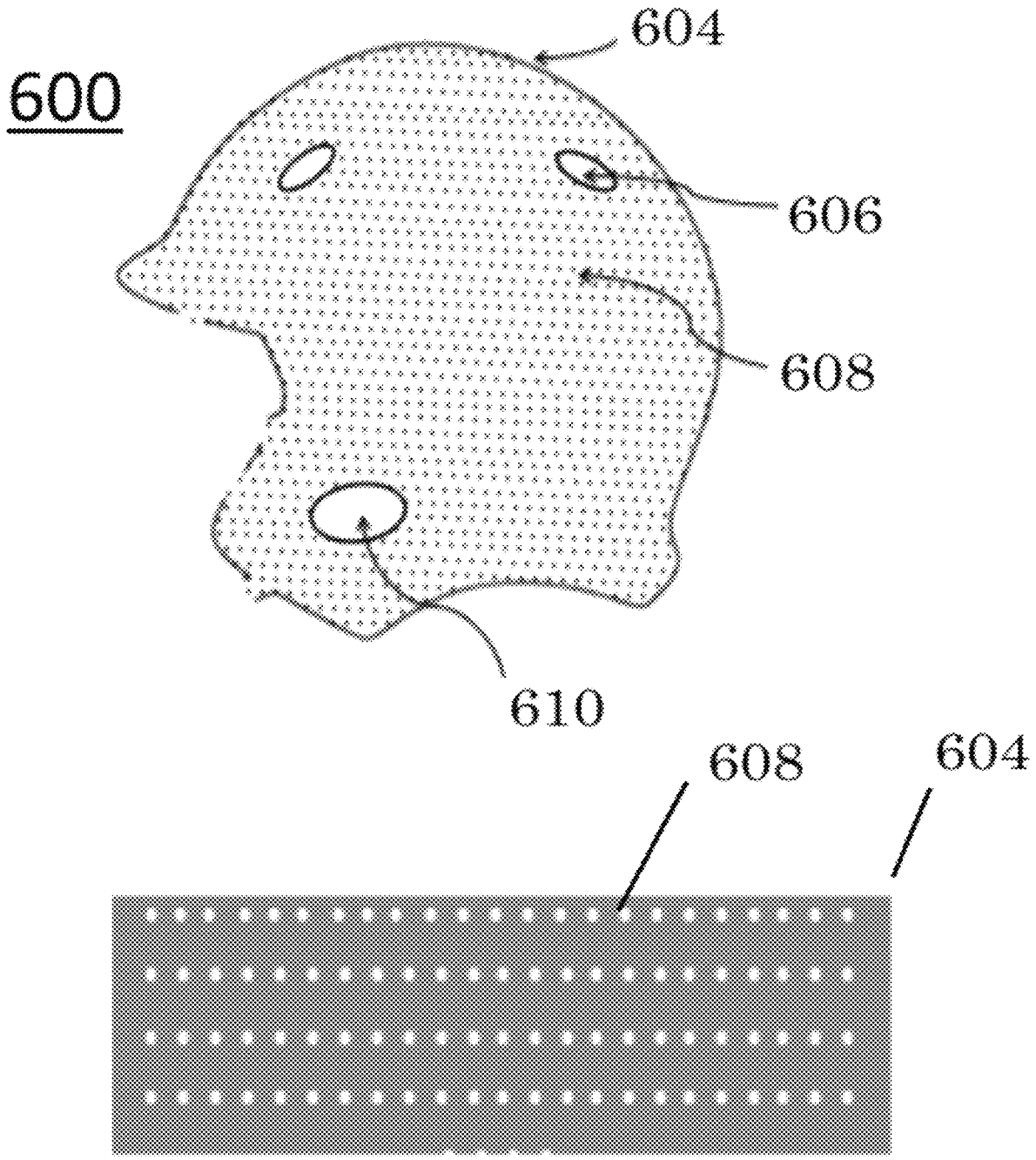
FIG. 4 shows the cage assembly with perforated shell in accordance with an embodiment of the invention.

Turning to FIG. 4, a perforated shell 600 has an inner and outer surface 604 that conforms to the shape of the cage 400 (FIG. 5) such that the shell is placed over the cage. The shell may be constructed by way of example and not limitation, from a thin high strength plastic or a lightweight titanium material having a thickness of approximately 1 millimeter. The shell contains thereon its surface 604, perforations 608, of varying size, shape, quantity, and placement, to allow for the flow of air or sound, and permits the affixation thereon of impact absorbent materials installed integrally over all shell surface areas 600. Vent holes 606, 610 conform to the opening 102, 110 in the helmet 100.

Figure 5:
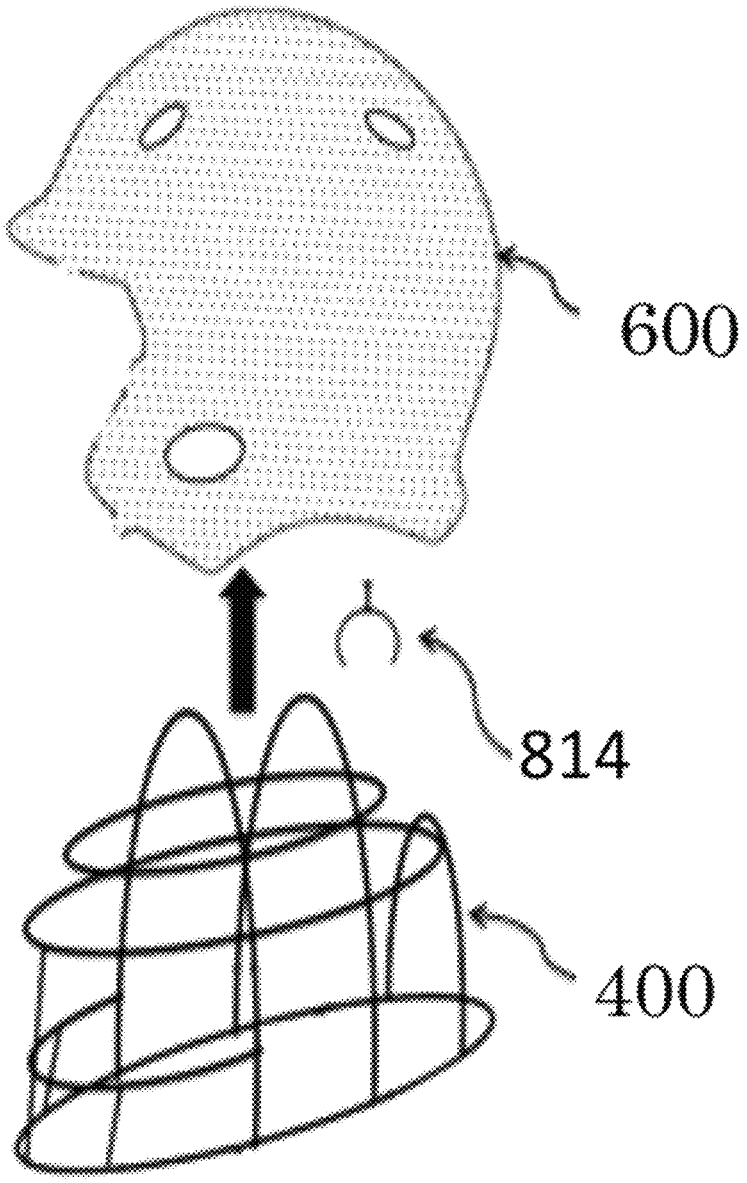
FIG. 5 illustrates the perforated shell inserted over the cage assembly, the combination in accordance with an embodiment of the invention.
Figure 6:
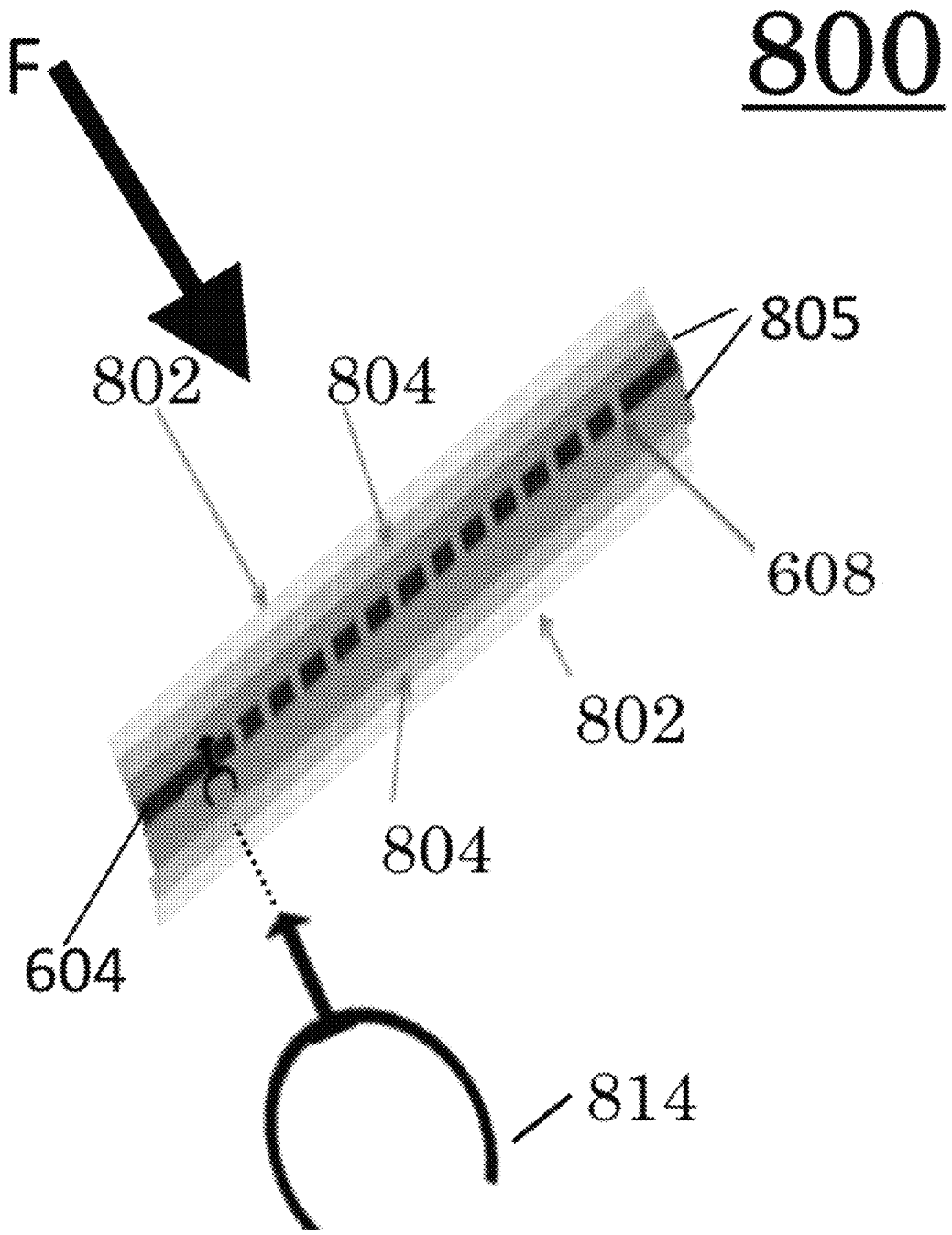
FIG. 6 is a view of the shell and clip assembly and cushioning assembly of the helmet in accordance with an embodiment of the invention.

As shown in FIG. 5, the cage 400 fits conformably into the shell 600, whereby the cage 400 provides mechanical support for the shell 600. The cage 400 is then covered with the cushioning layer, e.g., SORBORTHANE (FIG. 6, 805). The outermost layer 802, which is an EVA copolymer, such as CROSLITE, creates the final shape of the helmet. This material has clarity and gloss, low-temperature toughness, stress-crack resistance, hot-melt adhesive waterproof properties, and resistance to UV radiation.

Referring to FIG. 6 a cross section of an assembly 800 serves to distribute and transfer the impact of the imposing force F to the shell 604, i.e., through the absorbent materials 802, 805 (e.g., CROSLITE and SORBORTHANE), thus reducing the forces that ultimately cause the brain to move within the skull. More particularly, the shell surfaces 604 are covered with the viscoelastic polymer material 805, such as SORBORTHANE, or other cushioning material that has similar shock absorption and vibration reducing properties. The cushioning 805 material penetrates the perforations 608 to integrate the shell, cage via clips 814, as will be described below. The Sorborthane 805 is then covered with a second shock absorption material 802, such as CROSLITE, which as indicated serves as the exterior surface for the helmet. The SORBORTHANE 805, forms and adheres against the shell on its surface areas 604 and through the surface perforations 608, and merges with the CROSLITE material 802. The two materials, 802, 805 are held stable and in contact with each other and the shell 600, via the process of thermal molding or adhesives. Additional inner cushioning materials may be cut to shape and placed/glued in to allow for customization on helmet surface areas closest to the body.

Referring to FIG. 6, in an alternate embodiment, the SORB ORTHANE 805 or other cushioning material that has similar shock absorption and vibration reducing properties, is then covered with a second material to provide additional strength or rigidity to the structure such as by way of example, a polyethylene powder coating 804. The second material 804 is then covered with a third shock absorbing material 802, such as CROSLITE, which as indicated serves as the exterior surface for the helmet. The SORB ORTHANE 805, forms and adheres against the shell on its surface 604 areas through the surface perforations 608, and merges with the polyethylene powder coating 804. The polyethylene powder-coating surface 804 forms and adheres against an outer shock absorption material such as CROSLITE 802. The materials, 802 and 804 are each held stable and in contact with each other, and the materials, 805 and 804 are each held stable and in contact with each other and with the shell 604, via the process of thermal molding or adhesives. Additional inner cushioning materials not shown, may be cut to shape and placed/glued in to allow for customization on helmet surface areas closest to the body.

An outer coating, such as EVA copolymer or CROSLITE 802, provides several advantages over the current art, which is typically constructed with a hard outer shell plastic known as polycarbonate alloy. By way of example and not limitation, exterior use of a closed cell resin, such as EVA copolymer, increases impact absorption unlike today's helmets made of a plastic alloy. This characteristic extends helmet durability and reduces wear that can occur during frequent or prolonged use, including non-safety related scuffing or scratching that may occur during use or storage. Resins such as CROSLITE are available in a wide range of colors. During manufacturing, the outer coating may be molded to add identifiers such as a team logo or name, or player name or number. Some closed cell resins have anti-microbial properties reducing odor, and the need for harsh chemicals especially when a helmet is used by multiple players. Also, resin will easily adhere to a wide range of other cushioning systems, materials or spacers that may also be used in conjunction with the final helmet to enhance safety and comfort.

Figure 7:
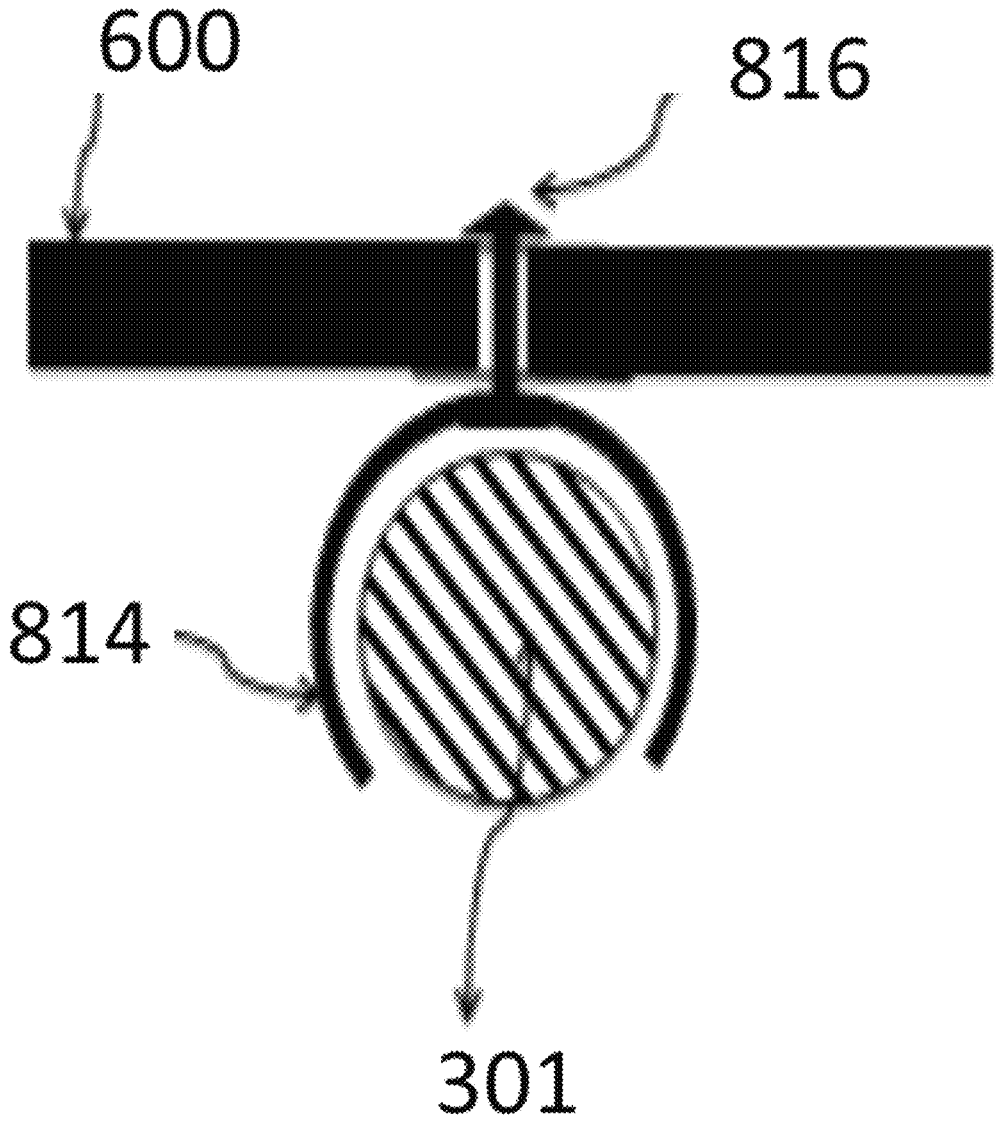
FIG. 7 shows mechanism for attaching the shell to the cage in accordance with an embodiment of the invention.

FIG. 7, illustrates the clip 814 that integrates the shell 600 (FIG. 4) and the cage 400 (FIG. 5), by affixing a plurality of clips 814, which are inserted into perforations 608 in the shell 600. The clips secure the cage at one or more points along the u-shaped bars, as shown by bar 301, and halo rings, as shown by 203, by tension-snapping its sides onto bar 301, 203 and then lodging a stop 816 into the perforation 608, so that it cannot loosen or be removed as the helmet 100 is being used. The viscoelastic polymer material (FIG. 6, 805) serves to further secure the shell 600, cage 200 and clips 816.

Figure 8:
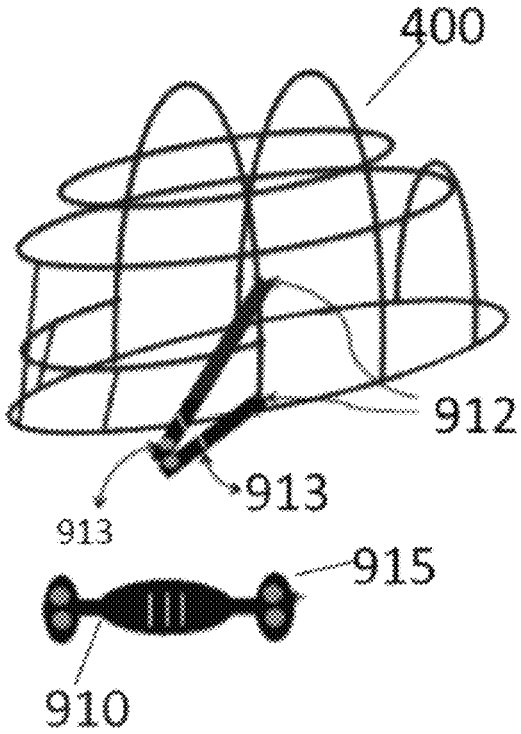
FIG. 8 shows the cage and shell assembly and chin straps in accordance with an embodiment of the invention.

FIG. 8 shows, in another non-limiting embodiment, the helmet cage 400 manufactured for affixing chin guard straps 910. By way of example and not limitation, one or more attachment straps are secured at attachment 912, to the cage 400, u-shaped bar and/or halo ring 201, through narrow openings in the shell 600 and/or as may be embedded within one or more of the cushioning layers. At the distal end of each strap are one or more connectors 913, and corresponding chin guard strap 910 snaps 915, or clips, used to connect each distal end to a separate unconnected chin protector. The chin protector also has connectors for attaching the chin protector to each distal end of the chin guard straps 910. Any one or more of the chin straps or chin protector may also include a means for adjusting one or both so that the helmet fits comfortably and safely. In one non-limiting embodiment, the exterior of chin protector on the side opposite the chin, has excess material to improve grip for quick manual removal. The connectors used have a minimal profile for player comfort and to minimize injury to other players.

In another non-limiting embodiment, all or a portion of the facemask area located below the topmost halo ring 203 (FIG. 4) may be fitted with an optional clear, shatterproof shield, to provide added face protection. The shield may have other characteristics such as hard coating for scratch resistance, ultraviolet coating for eye protection against ultraviolet rays, lens polarization for glare or photochromic lenses for changing light conditions. Alternatively, the shield may also permit the use of visual technology enhancements, known generally as "Google Glass" or technologies that may allow players to access and view playbooks, record plays in real-time, gather and share information useful to the game play, or allow for audiovisual communication among players or between players and coaches.

Figure 9:
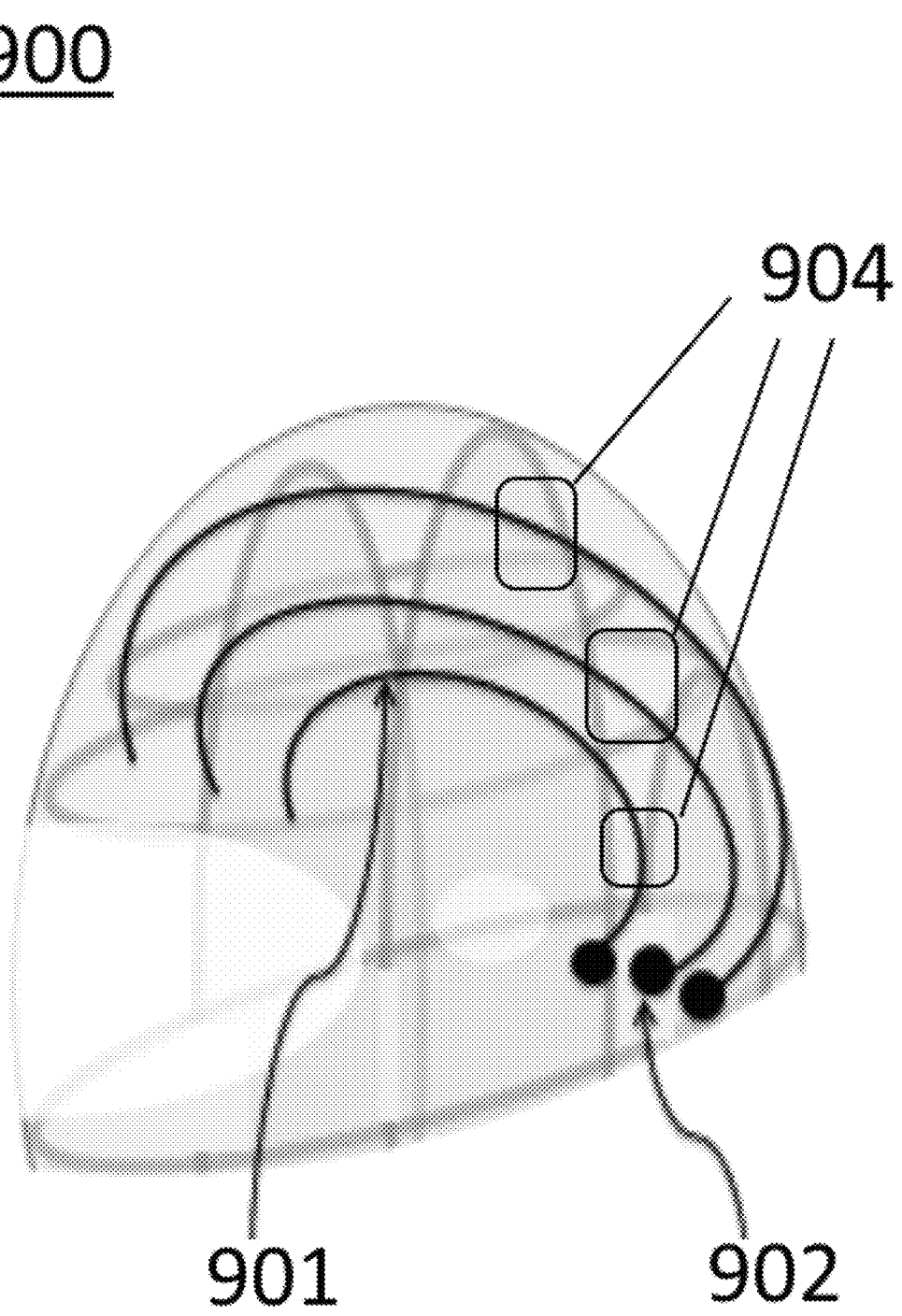
FIG. 9 shows the relief tubes, valves and electronics, in accordance with an embodiment of the invention.

Turning to FIG. 9, in one non limiting embodiment, embedded in one or more of the cushioning layers are flexible or crush resistant tubes 901. The tubes serve a variety of purposes, including, but not limited to, absorbing shock, weight reduction, air cushioning, and mechanisms for detecting the location of impact. The closed end of the tube is located within the closed cell resin cushioning layer or alternatively, within the viscoelastic polymer material. The distal end of the tube terminates at the base of the finished helmet. The tube temporarily deforms upon impact, dampening impacts as it forces air to escape, and thereafter returns substantially to its original shape. Alternatively, the distal end of each tube terminates at the finished helmet base into which is inserted a relief valves 902. The relief value remains closed until activated by a pre-determined impact force causing the valve to open.

In FIG. 9, an alternate embodiment, the tube and valve system 900 may serve as a low cost early visual warning system by providing general the location upon the head of an impact that could result in a serious physical injury, or death. Such alert data may be recorded by automated or manual means, to monitor player health and safety, or helmet wear. For example, the relief valve may remain closed until activated by an impact force that causes the value to open. The opening of the valve 902 may trigger a visual indicator, such as a brightly colored or color-coded button-type indicator, or release of a powder, liquid, gel or combination non-toxic, non-staining, substance or light emitting diode (LED) or sensor-activated light. The visual indicator may in some cases relate to one or a group of relief tubes to indicate the location of impact. By way of example, and not limitation an impact to the left temporal region may trigger the release of one or more bright red release valve buttons, whereas an impact to the right temporal region may trigger the release of one or more bright green release valve buttons.

In an alternate embodiment, again referring to FIG. 9, upon detection of an external force, a valve 902 opens triggering a visual indicator, which may include the activation of a sensor that transmits a wireless signal to a receiver such as a tablet or phone, to indicate the presence and location of impact. More particularly, one or more of the trigger valves 902 contains an electronic device 904, containing a wireless technology for transmission of a radio signal, carrying information regarding one or more of an assortment of sensors, such as for gyroscopic sensing, acceleration and GPS. One device for transmission may incorporate WiFi or Bluetooth technology.

In one non-limiting embodiment, any one or more of the cage, shell or helmet may be constructed through a variety of processes and techniques, such as injection molding, thermoforming, 3D printing, additive manufacturing, metal forming, as well as utilizing adhesives, mating parts or other means of joining or molding materials. Such processes and techniques are well-known to those skilled in the art of manufacturing and assembling two-dimensional and three-dimensional shaped fixtures constructed from metals such as magnesium, carbon fiber or titanium, plastics and recyclable materials. By way of example and not limitation, once the halos, U-bars and face mask options are assembled through welding or spot welding, the assembled cage is dipped into a liquid plastic so as to coat the entire cage evenly. In one embodiment the liquid plastic is industry standard face mask material.

In one embodiment that portion of the assembly that consists only of the helmet and the bottom most halo that serves as a chin protector are then placed into a mold, excluding that portion of the helmet that consists of the facemask and chin straps. The facemask and chins straps are not covered with any cushioning material. The remaining portion of the helmet is then covered with a first layer of cushioning material by injection molding or by pouring material into the mold.

In one embodiment, the assembly described above is covered with SVUP, in which case, a second layer of cushioning material may also be applied which may include alternatively a closed cell resin polymer, or other cushioning material.

Thereafter, the material that protected the chin straps may be removed, and the user may add additional features such as adjustable chin strap connectors and additional chin protective cushioning, or other independently supplied cushioning material for the interior of the helmet which may provide yet a further layer of protection and/or user comfort.

While this invention may be described in relation to football helmets, it is contemplated that it could be adapted for use in any type of helmet. For example it could be used in hockey helmets, motorcycle helmets, baseball helmets, bicycle helmets, ski/snowboard helmets, skateboarding helmets, lacrosse helmets, etc. The invention could be adapted for any headgear worn by a person to reduce the likelihood of head trauma.

The present invention has been described with reference to the preferred embodiments, it should be noted and understood that various modifications and variations can be crafted by those skilled in the art without departing from the scope and spirit of the invention. Accordingly, the foregoing disclosure should be interpreted as illustrative only and is not to be interpreted in a limiting sense. Further it is intended that any other embodiments of the present invention that result from any changes in application or method of use or operation, method of manufacture, shape, size, or materials which are not specified within the detailed written description or illustrations contained herein are considered within the scope of the present invention.

What is claimed is:

1. A helmet suitable for head protection to comprised of: an outer shell of a first impact absorbing polymer;

a conformable inner layer of an impact absorbing polymer adapted to be positioned over a wearer's head;

a shock absorbing layer located between an outer layer and the inner layer, wherein the shock absorbing layer further includes one or more halo rings rigidly affixed to one or more u-shaped torsion bars, forming a cage wherein:

(i) the cage is covered with a conforming perforated shell;

(ii) a plurality of clips attach the cage to the conforming perforated shell, wherein the clips are inserted into perforations in the conforming perforated shell, and the perforations are configured and spaced apart to cover substantially all of a surface of the conforming perforated shell and wherein a plurality of the perforations are configured for permeation of the shock absorbing layer through the perforations;

(iii) the cage, the conforming perforated shell and the clips are covered with an absorbing polymer material; and (iv) the cage, conforming perforated shell and clips are further covered by the outer shell.

2. The helmet of claim 1, wherein the outer shell of impact absorbing polymer is ethylene vinyl acetate.

3. The helmet of claim 1, wherein the outer shell of impact absorbing polymer is a closed cell resin material.

4. The helmet of claim 2, wherein the outer shell of impact absorbing polymer is further coated with a polyethylene powder coating.

5. The helmet of claim 1, having two or more vents for one or more of hearing and cooling.

6. The helmet of claim 1, wherein the shock absorbing layer is covered by a synthetic viscoelastic urethane polymer layer positionable over the shock absorbing layer.

7. The helmet of claim 1, wherein the shock absorbing layer includes embedded flexible crush resistant tubes.

8. The helmet of claim 7, wherein one or more of the flexible crush resistant tubes include a relief valve at a termination point near a helmet base that opens when activated by a predetermined force.

9. The helmet of claim 7, wherein one or more valves trigger a visual indicator when activated by the predetermined force.

10. The helmet of claim 7, wherein the application of the predetermined force triggers a wireless technology providing data, such as player information, measurement of applied forces, acceleration, and gyroscopic and GPS positioning.

11. The helmet of claim 10, wherein the cage includes anchor points for securing at least one strap.

12. The helmet of claim 1, wherein the outer shell, includes impact absorbing resin, joined by a process of one or more of thermal molding or use of adhesives to the shock absorbing layer.

13. The helmet of claim 1, wherein the cage is comprised of:

(i) a first halo ring, halo-1, forming the base of the cage, (ii) a second halo ring, halo-2, smaller in diameter than halo-1 placed above and essentially parallel to halo-1, and (iii) a third halo ring, halo-3, smaller in diameter than halo-2, placed above and essentially parallel to halo-2, and (iv) two or more inverted "U" shaped bars that intersect with each halo ring, forming a protective cage.

14. A method of protecting a wearer from any force that results from single or repetitive collisions which comprises:

(a) constructing a cage of three or more halo rings and two or more "U"-shaped bars, (b) using a plurality of clips for connecting the cage to a thin conforming perforated shell, wherein the plurality of clips are inserted into perforations in the conforming perforated shell, and the perforations are configured and spaced apart to cover substantially all of a surface of the conforming perforated shell and wherein a plurality of the perforations are configured for permeation of the shock absorbing layer through the perforations, (c) covering the cage and the thin conforming perforated shell with a polymer forming a shock absorbing inner layer, (d) covering the shock absorbing inner layer and an outer layer with a co-polymer, the co-polymer including a closed cell resin material.

15. The method of claim 14, wherein the polymer of the shock absorbing inner layer and the outer layer, includes a layer of synthetic viscoelastic urethane.

16. The method of claim 14, wherein the closed cell resin material includes a layer of ethylene vinyl acetate.

* * * * *